US007037018B1

(12) United States Patent
Shai

(10) Patent No.: US 7,037,018 B1
(45) Date of Patent: May 2, 2006

(54) ART PAINT ROLLING SYSTEM

(76) Inventor: Moti Shai, 3524 Via del Prado, Calabasas, CA (US) 91302

( * ) Notice: Subject to any disclaimer, the term of this patent is extended or adjusted under 35 U.S.C. 154(b) by 74 days.

(21) Appl. No.: 11/129,701

(22) Filed: May 16, 2005

(51) Int. Cl.
*B05C 1/00* (2006.01)
*B05C 17/025* (2006.01)
*B05C 17/03* (2006.01)
*B05C 17/035* (2006.01)

(52) U.S. Cl. ..... 401/197; 401/220
(58) Field of Classification Search ..... 401/196, 401/197, 208, 219, 220
See application file for complete search history.

(56) References Cited

U.S. PATENT DOCUMENTS 673,960 A * 5/1901 Looker ..... 401/197
6,109,809 A * 8/2000 Pistis ..... 401/197

* cited by examiner

*Primary Examiner*—Justine R. Yu
*Assistant Examiner*—Huyen Le

(57) ABSTRACT

A paint roller having multiple reservoirs for holding paint is disclosed. The paint roller includes at least two paint storage reservoirs for storing paint; openings from the reservoirs to an outer surface; and a cylindrical sponge mounted around the outer surface to absorb paint from the paint storage reservoirs and/or an outside source. A handle can be attached to the paint roller, and additional refill reservoirs can be incorporated into the handle to refill the reservoirs within the roller, with integrated valves to regulate the flow of paint. A method of painting with at least three colors using the claimed paint roller is also disclosed, wherein paint is distributed onto the cylindrical sponge simultaneously from the paint storage reservoirs and an outside source.

11 Claims, 2 Drawing Sheets

Cross section AA'

ART PAINT ROLLING SYSTEM

BACKGROUND OF THE INVENTION

The present invention relates to paint rolling tools and apparatuses that are utilized to apply paint to objects, specifically in the context of artwork.

A paint roller and pan are frequently used by both professionals and do-it-yourselfers for many different painting applications, and techniques for using both rollers and pans are well-known in the art. These simple tools are often the best available tools for painting particular objects, such as walls.

When using a paint roller and pan, however, both the pan and the paint roller must be replenished with paint on a frequent basis. This is time consuming, and results in an inefficient way of applying paint to objects. As a result, it has been suggested to include a reservoir for paint within the paint roller tool itself. Additionally, traditional roller techniques allow application of only one color of paint per roller at a given time. These techniques limit the designs and paint patterns that can be created without the use of brushes. Accordingly, it has been suggested to include multiple paint reservoirs within the paint roller tool for applying multiple paint colors simultaneously.

SUMMARY OF THE INVENTION

In accordance with the present invention, a cylindrical outer roller surface provides multiple cavities or reservoirs in which paint can be held in the claimed paint roller. The outer roller surface has a plurality of openings, which are preferably circular holes. A cylindrical sponge affixed to the outer surface absorbs paint from the reservoirs through the plurality of openings, and in turn deposits the paint onto a surface during rolling. While the sponge may be permanently affixed, it is preferred that it be removable, as removable sponges are easier to clean. In addition, removable sponges enable the user to choose between sponges with various artistic patterns, or characteristics better suited to the surface being painted.

Sealed caps fit over the ends of the outer roller surface to contain paint within the cavities or reservoirs inside the paint roller. In preferred embodiments, the caps include centralized holes through which paint can flow into specific reservoirs. Delivery tubes inside hollow roller arms may interface with these centralized holes to allow paint flow from refill reservoirs into the roller reservoirs.

The present invention also includes methods of painting. As an example, one may provide a painting tool for dispensing paint comprising a handle and a roller with a cylindrical outer surface connected to the handle via hollow roller arms. The outer roller surface will have a plurality of openings, and be surrounded by a removable cylindrical sponge capable of absorbing paint through said openings. The method includes filling the roller reservoirs with different colors of paint and manipulating the painting tool so as to paint a surface with said different colors of paint simultaneously. This method further includes refilling the roller reservoirs from refill reservoirs in the handle via the hollow roller arms, and regulating the refill rate with valves. Finally, the method may also include dipping the sponge into yet another color of paint to enhance the pattern created on the painted surface.

DESCRIPTION OF THE PREFERRED EMBODIMENT

Figure 1:
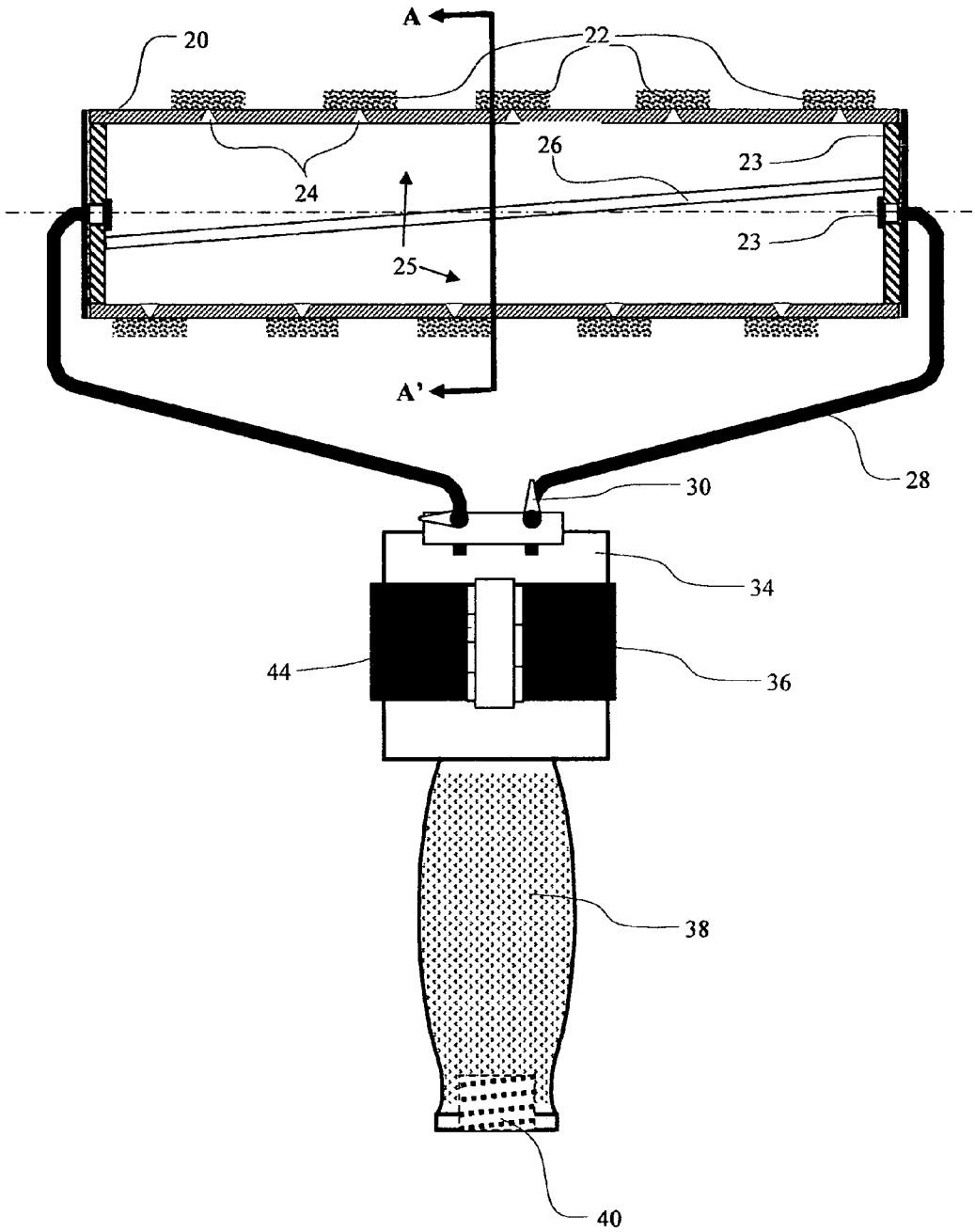
FIG. 1 illustrates a cross section of the paint roller of the present invention; and a top view of the paint delivery system of the present invention.
Figure 2:
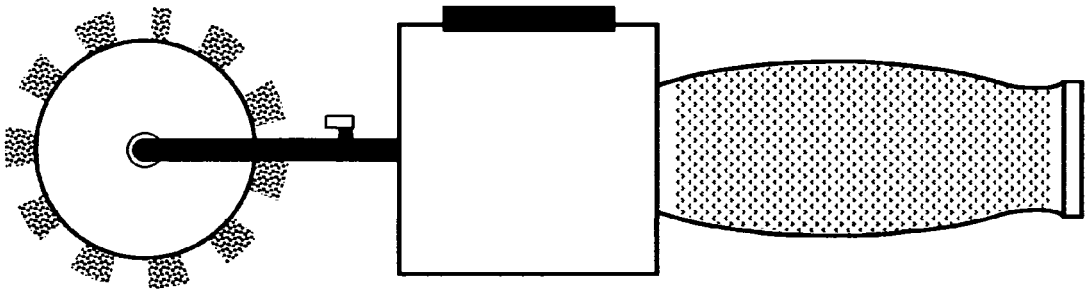
FIG. 2 illustrates a side view of the of the preferred embodiment of the paint roller and paint delivery system of the present invention.
Figure 3:
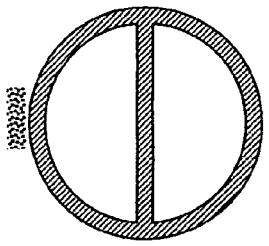
FIG. 3 depicts a cross-sectional side view (AA') of the preferred embodiment of the paint roller of the present invention.

The following describes an exemplary embodiment of the paint roller and delivery system of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

Referring to the figures, FIG. 1 shows a cross section of the paint roller and a top view of the paint delivery system of the preferred embodiment of the present invention. The paint roller includes a cylindrical outer surface 20 with a plurality of openings 24, multiple paint reservoirs 25 formed by a divider 26, and end caps 21 with centralized openings 23. The outer surface 20 is surrounded by a cylindrical sponge 22, which may be patterned as shown.

The paint delivery system includes hollow roller arms 28 that interface with the end cap openings 23 to allow paint flow from refill reservoirs 34 into the roller reservoirs formed by the outer roller surface 20 and divider 26. Valves 30 regulate this paint flow, while sealable openings 36 rotating on hinges 44 allow access to the refill reservoirs. The paint delivery system further comprises a handle 38 with a threaded base 40.

The present invention also includes methods of painting. As an example, one may use the preferred embodiment of the paint roller to paint a surface with three different colors of paint simultaneously. Although sponges of any texture may be used, increasingly creative paint patterns can be created using sponges with patterned (rather than smooth) surfaces such as the sponge shown in FIG. 1. The preferred method includes filling the paint reservoirs 25 with different colors of paint and then using the roller to apply paint by rolling it against a surface. Paint from the reservoirs will be absorbed by the sponge 22 through the plurality of openings 24 and subsequently transferred to the surface being painted. The preferred method further includes coating the sponge 22 with a third color of paint through traditional paint tray and roller techniques. The resulting painted surface will then contain four colors: three from the roller plus the original surface color (the surface is only partially covered with paint when using a patterned sponge).

Another preferred method includes using the disclosed paint delivery system in conjunction with the roller, wherein the paint reservoirs 25 in the roller are replenished via hollow roller arms 28 with paint from refill reservoirs 34. Paint is deposited in the refill reservoirs 34 via sealable openings 36, and paint flow to and from the roller paint reservoirs 25 is regulated by gravity (tilting the roller and paint delivery system assembly) and valves 30.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A paint roller for dispensing paint, comprising:

at least two paint reservoirs for holding paint;

a cylindrical outer surface surrounding the reservoirs, the outer surface having a plurality of openings, and two open ends;

caps enclosing said open ends of said outer surface;

and a cylindrical sponge mounted around the outer surface to absorb paint from the paint reservoirs and/or an outside source;

wherein the reservoirs may be filled with different paints which permeate through the plurality of openings in the outer surface and into specific portions of the cylindrical sponge a handle; at least two refill reservoirs incorporated into the handle; two hollow roller arms extending from the handle and terminating at open ends; at least one delivery tube within each of said hollow roller arms for receiving paint therethrough, said tube extending from one of the refill reservoirs in the handle and terminating at one of said open ends; and at least two valves to regulate the flow of paint through the delivery tubes; wherein paint can flow through the delivery tubes from the refill reservoirs to the open ends of the hollow roller arms, regulated by said valves.

2. The paint roller of claim 1, wherein said caps further comprise apertures to allow paint flow into and out of the reservoirs.

3. The paint roller of claim 1, wherein the cylindrical sponge further comprises a contoured pattern.

4. A method of painting with multiple colors using the paint roller of claim 1 comprising:

filling the at least two paint reservoirs of the paint roller with different paints;

allowing the cylindrical sponge to absorb the paints through the outer surface openings;

and transferring the absorbed paints from the cylindrical sponge onto a surface by rolling the paint roller along the surface to create a pattern.

5. The method of claim 4 further comprising the step of externally coating the cylindrical sponge with an additional paint prior to transferring paints onto a surface, such that the pattern created on the surface will consist of at least three colors.

6. The method of claim 5 wherein the cylindrical sponge further comprises a contoured pattern such that certain portions of the cylindrical sponge do not transfer paint to a surface when rolled, leaving those areas of the surface with their original colors resulting in a surface pattern consisting of at least four colors.

7. The method of claim 6 further comprising the step of rotating the paint roller 180 degrees such that the enclosed open ends exchange relative positions, and transferring paint onto the same surface atop the previously created pattern, thereby creating a more colorful pattern.

8. The method of claim 4 wherein the cylindrical sponge further comprises a contoured pattern such that certain portions of the cylindrical sponge do not transfer paint to a surface when rolled, leaving those areas of the surface with their original colors resulting in a surface pattern consisting of at least four colors.

9. The method of claim 8 further comprising the step of rotating the paint roller 180 degrees such that the enclosed open ends exchange relative positions, and transferring paint onto the same surface atop the previously created pattern, thereby creating a more colorful pattern.

10. A paint delivery system for supporting a paint roller and refilling multiple paint reservoirs including:

a handle;

at least two refill reservoirs incorporated into the handle;

two hollow roller arms extending from the handle and terminating at open ends;

at least one delivery tube within each of said hollow roller arms for receiving paint therethrough, said tube extending from one of said refill reservoirs in the handle and terminating at one of said open ends;

and at least two valves to regulate the flow of paint through the delivery tubes;

wherein paint can flow through said delivery tubes from the refill reservoirs to the open ends of the hollow roller arms, regulated by said valves.

11. The paint delivery system of claim 10, wherein the refill reservoirs further comprise sealable openings through which paint can be deposited or removed.

* * * * *